US007874326B1

(12) United States Patent
Harvey

(10) Patent No.: US 7,874,326 B1
(45) **Date of Patent: *Jan. 25, 2011**

(54) MULTIPURPOSE FUNNEL SYSTEM

(76) Inventor: Travis Harvey, 909 Galbreath Ave., Boothwyn, PA (US) 19061

( * ) Notice: Subject to any disclaimer, the term of this patent is extended or adjusted under 35 U.S.C. 154(b) by 999 days.

This patent is subject to a terminal disclaimer.

(21) Appl. No.: 11/712,755

(22) Filed: Mar. 1, 2007

(51) Int. Cl.
*B65B 1/04* (2006.01)

(52) U.S. Cl. ..... 141/330; 141/335; 141/340; 222/86

(58) Field of Classification Search ..... 141/1, 141/2, 312, 319, 329–345; 222/83–86, 472
See application file for complete search history.

(56) References Cited

U.S. PATENT DOCUMENTS 4,202,386 A 5/1980 Orr ..... 141/300
4,705,192 A * 11/1987 Knapton ..... 222/144.5
5,228,488 A * 7/1993 Fletcher ..... 141/331
5,787,944 A 8/1998 Sarkis ..... 141/300
6,142,193 A 11/2000 Sanders ..... 141/300
7,237,582 B1 * 7/2007 Harvey ..... 141/330
7,284,581 B2 * 10/2007 Steinweg ..... 141/340

* cited by examiner

*Primary Examiner*—Timothy L Maust
(74) *Attorney, Agent, or Firm*—Janine D. Geraigery; Law Offices of J. D. Geraigery

(57) ABSTRACT

An improved multipurpose funnel system for filling a container which prevents overflow during filling is self venting and is capable of filling hard to reach container locations. The system has a funnel removably coupled to a bottle cartridge which holds bottles therein. A pair of parallel rods hingedly connected to the bottle cartridge and having at least one hollow cone shaped spike extending outwardly therefrom. The funnel has a downspout having venting tubes, an elongated tip and a ball and socket mechanism. The elongated tip includes a check valve having an inside sleeve having an opening, and a spring. The inside sleeve extends outwardly and inwardly from the elongated tip, which opens and closes the opening. The elongated tip has an exterior lip extending outwardly therefrom.

15 Claims, 7 Drawing Sheets

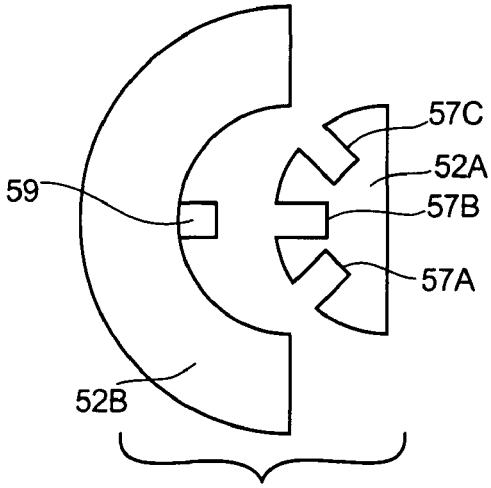
FIG. 10A
FIG. 10B
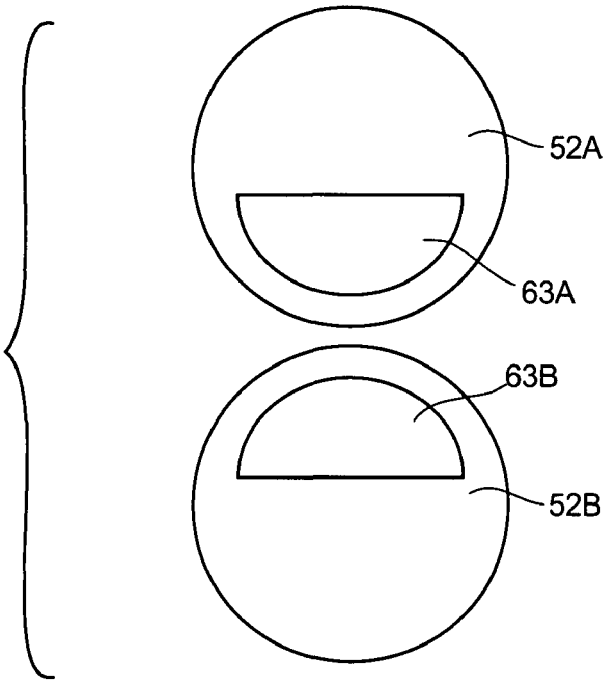

MULTIPURPOSE FUNNEL SYSTEM

BACKGROUND OF THE INVENTION

The invention relates to a funnel, and more particularly, to an improved multipurpose funnel system for filling a container which prevents overflow during filling, is self venting and is capable of filling hard to reach container locations.

It is not always easy to determine when, or if, major repairs, perhaps even a complete overhaul is required for an automobile truck or engine. High mileage is not necessarily an indication that engine work is needed, just as low mileage does not preclude the need for maintenance action. An engine that undergoes regular and frequent oil changes, as well as other required maintenance, will most likely provide many thousands of miles of reliable service. Conversely, a neglected engine may require an overhaul very early in life.

Most motorists realize the need to check the oil on a frequent basis to ensure that the oil level is sufficient to supply the required amount of lubricating oil to the engine. Additionally, manufacturers recommend that oil be changed every 3,000 miles or so. Whenever oil is added to an engine, the oil cap must be removed and, ideally, a funnel inserted into the oil filler opening to prevent oil from spilling onto the engine block and the area beneath the engine block. The funnels that are used for this purpose are manually positioned in the oil fill opening, after the cap has been removed, and a bottle of oil poured into the funnel. The bottle must be held in until all of the oil has been poured. Most automotive vehicles require four or five quarts of oil, depending on the size of the engine, when the filter is replaced, and each quart bottle of oil must be held until the last bottle is emptied. This is not an overly demanding task, physically, but it is a time consuming task.

U.S. Pat. No. 4,202,386 to Orr discloses a funnel for use in filling containers with liquid and designed to prevent overflowing of the container during filling.

U.S. Pat. No. 5,787,944 to Sarkin et al. discloses a self venting funnel that automatically vents air from a system or container while a fluid or solid material is being introduced therein.

U.S. Pat. No. 6,142,193 to Sanders discloses a self venting multipurpose funnel having a plurality of sections of varying diameter.

While these units may be suitable for the particular purpose employed, or for general use, they would not be as suitable for the purposes of the present invention as disclosed hereafter.

SUMMARY OF THE INVENTION

It is an object of the invention to produce a funnel which can access hard to reach containers. Accordingly, the invention is a multipurpose funnel system including a funnel and a bottle cartridge, wherein the funnel has an elongated tip which is angled to allow access to hard to reach containers.

It is another object of the invention to provide a funnel capable of securely interlocking with a bottle cartridge. Accordingly, the funnel of the invention includes a downspout having a top having interlocking tabs thereon for conveniently interlocking with and securing to the bottle cartridge.

It is another object of the invention to provide a funnel capable of filling containers which prevents overflow of the container during filling. Accordingly, the funnel of the invention includes a check valve which works in conjunction with the elongated tip of the downspout, such that liquid flows there through only when pressure is applied to the elongated tip, thereby preventing overflow.

It is another object of the invention to provide a convenient means for self venting the funnel. Accordingly, the invention includes a plurality of venting tubes within the downspout which allow for faster flow of liquid.

It is another object of the invention to provide a means for allowing liquid to drain from a bottle into a container more quickly. Accordingly, the invention includes rods which hold inverted bottles of liquid in position within the bottle cartridge and said rods have cone shaped spikes which puncture the bottles, thereby allowing liquid to drain from the bottle into the container more quickly.

It is another object of the invention to provide a means for regulating the flow of a fluid through the funnel system. Accordingly, the invention includes the elongated tip having internal grooves, and an exterior tip having a tab insertable over the elongated tip to regulate the flow of liquid.

This invention is an improved multipurpose funnel system for filling a container which prevents overflow during filling is self venting and is capable of filling hard to reach container locations. The system has a funnel removably coupled to a bottle cartridge which holds bottles therein. A pair of parallel rods hingedly connected to the bottle cartridge and having at least one hollow cone shaped spike extending outwardly therefrom. The funnel has a downspout having venting tubes, an elongated tip and a ball and socket mechanism. The elongated tip includes a check valve having an inside sleeve having an opening, and a spring. The inside sleeve extends outwardly and inwardly from the elongated tip, which opens and closes the opening. The elongated tip has an exterior lip extending outwardly therefrom.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 10A is a diagrammatic perspective view of the funnel of the multipurpose funnel system of the present invention, wherein the socket includes an inner socket tip having internal grooves with three detent positions, and an outer socket tip having a tab that rides in the internal grooves to regulate the flow of liquid.

FIG. 10B is a diagrammatic perspective view of the funnel of the multipurpose funnel system of the present invention, wherein the inner socket tip and outer socket tip each have a half moon cover opening.

DETAILED DESCRIPTION OF THE PREFERRED EMBODIMENTS

Figure 1:
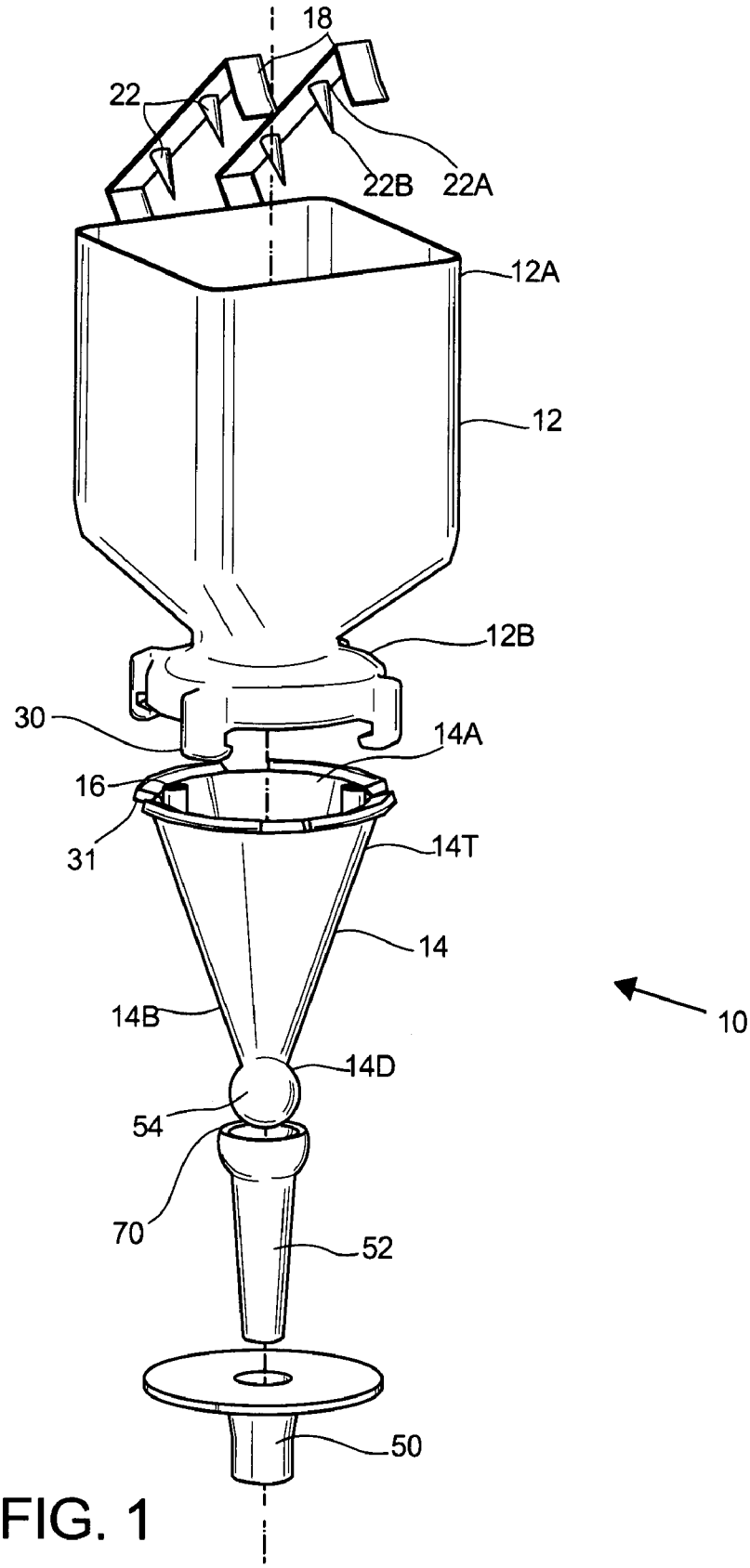
FIG. 1 is a diagrammatic perspective view of a multipurpose funnel system of the present invention having a bottle cartridge which interlocks with an interchangeable funnel having a downspout.

FIG. 1 illustrates a multipurpose funnel system 10 of the present invention for filling a container which prevents overflow during filling, is self venting and is capable of filling hard to reach container locations.

The funnel system 10 includes an interchangeable bottle cartridge 12, having a bottom and an open top end 12B and 12A and an interchangeable funnel 13 having a downspout 14. The funnel 13 is made up of the downspout 14 an elongated tip 50 and a ball and socket mechanism 70. The bottle cartridge 12 has capacity to hold four one quart bottles of liquid therein, preferably oil, simultaneously, in an inverted position for vertically placed oil fill entrances on valve covers. The bottle cartridge 12 preferably comes in two different sizes, one for holding four 1 quart bottles of oil used for automotive, marine and diesel use; the other bottle cartridge configuration is preferably for holding four 20 ounce bottles of oil for small engines.

The downspout 14 of the funnel 13 has an inside surface 14A, an exterior wall 14B, a top end 14T and a bottom end 14D. The downspout 14 is vented by a plurality of venting tubes 16. In the preferred embodiment, there are at least four venting tubes 16 spaced evenly around the inside surface 14A of the downspout 14. Alternatively, they may be along an outside surface of the downspout 14 or both. The venting tubes 16 are integrated into the downspout 14 allowing air to escape, prompting a faster flow of liquid. The air is pushed out and up the exterior wall 14B, and is vented on the top end 14T of the downspout 14 which allows the liquid to drain through the downspout 14 faster.

The bottle cartridge 12 is removably connected to the downspout 14 of the funnel 13, but is fully enclosed while connected with the bottle cartridge 12, thereby preventing spillage. The bottom end 12B of the bottle cartridge 12 has a plurality of interlocking tabs 30. The top end 14T of the downspout 14 has a plurality of corresponding notches 31 for accepting the interlocking tabs 30 of the bottle cartridge 12 and thereby securely connecting the downspout 14 thereto. The bottle cartridge 12 and funnel 13 can be easily replaced and interchanged as desired. Preferably, the bottle cartridge 12 and funnel 13 can be designed in different shapes, sizes and configurations in a plurality of different manners but due to a standardization of interlocking tabs 30 and notches 31 will always easily and conveniently interchange.

Figure 2:
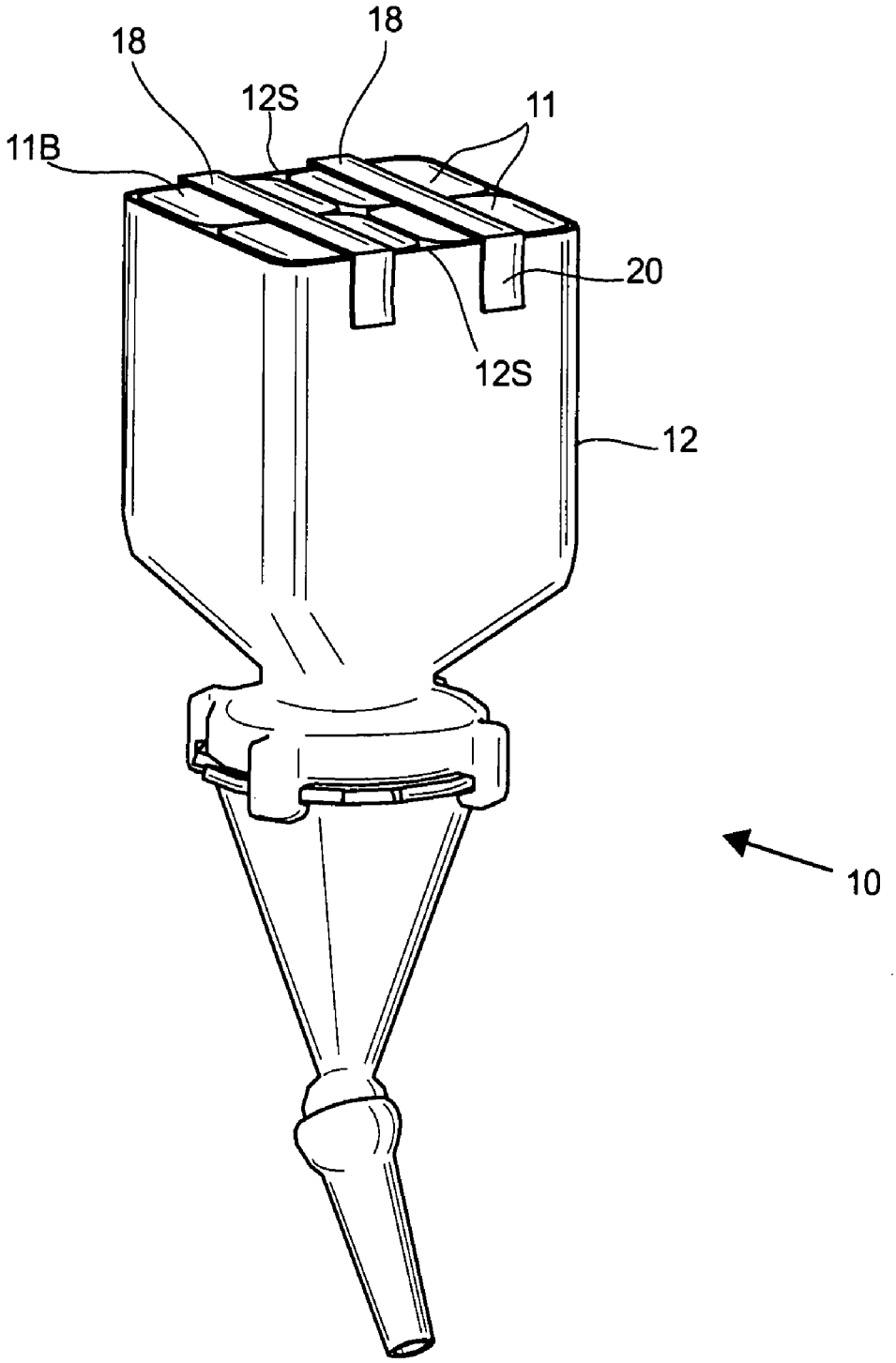
FIG. 2 is a diagrammatic perspective view of the multipurpose funnel system of the present invention having a pair of rods for holding inverted bottles within the bottle cartridge while in use.

FIG. 2 illustrates the multipurpose funnel system 10 of the present invention ready wherein bottles 11 of liquid are secured in position within the bottle cartridge 12. The open top end 12A of the bottle cartridge 12 has opposing sides 12S. A pair of parallel rods 18, preferably metal, are hingedly connected along one side 12S of the cartridge 12S. The rods 18 hinge closed across the open top end 12A and snap into a locking position 20 at the opposing side 12S.

As shown in FIG. 1, the rods 18 each include two hollow cone shaped spikes 22, preferably metal, extending outwardly therefrom. The spikes 22 have a top end 22A and pointed tip 22B. The top end 22A is preferably about ¼ inches in diameter and tapers down to the pointed tip 22B which is preferably ⅛ inch offset. At least four inverted bottles 11 of oil, having a bottom end 11B, are inserted within the bottle cartridge 12 bottom end 11B facing upwardly, as shown in FIG. 2. The pointed tips 22B assist in puncturing the bottom ends 11B of the inverted bottles. This allows air to flow in which then pushes oil downward with the help of gravity.

Figure 3:
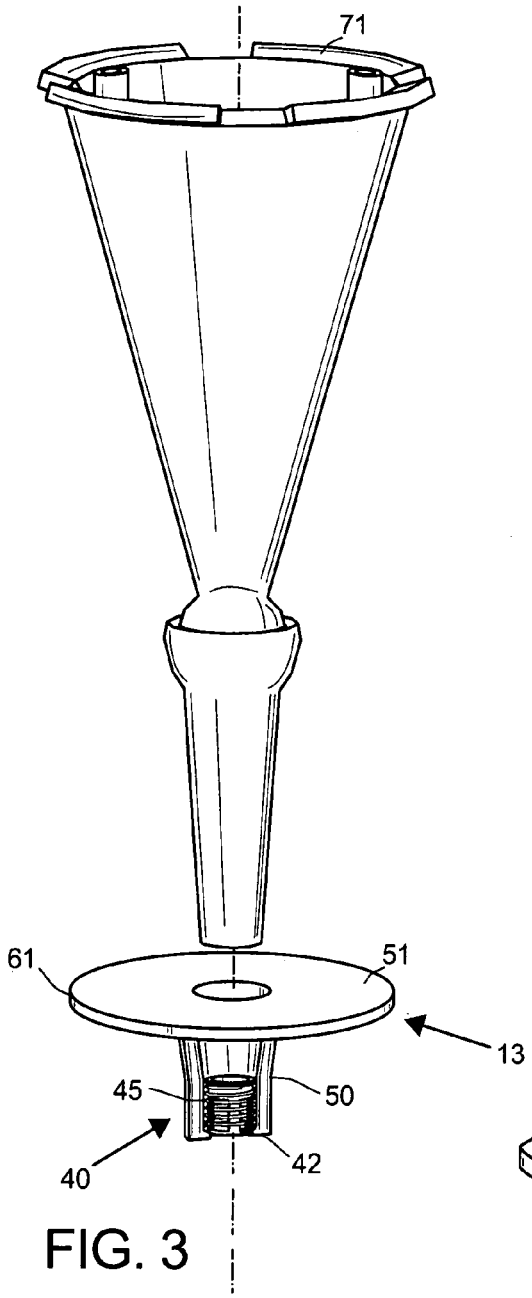
FIG. 3 is a diagrammatic perspective views of the funnel of the multipurpose funnel system of the present invention having a ball and socket mechanism and a check valve having a inside sleeve in the closed position.

Referring to FIGS. 1 and 3, the ball and socket mechanism 70 of the funnel 13 allows liquid to fill hard to reach containers by allowing the elongated tip 50 to rotate thereabout. The elongated tip 50 has a socket 52. The bottom end 14D of the downspout 12 includes a ball 54. The ball 54 of the downspout 12 is accepted by the socket 52 of the elongated tip 50 and together form the ball and socket mechanism 70. The elongated tip 50 freely rotates about the ball and socket mechanism 70 creating an angle for allowing said system 10 to fill hard to reach containers.

Figure 4:
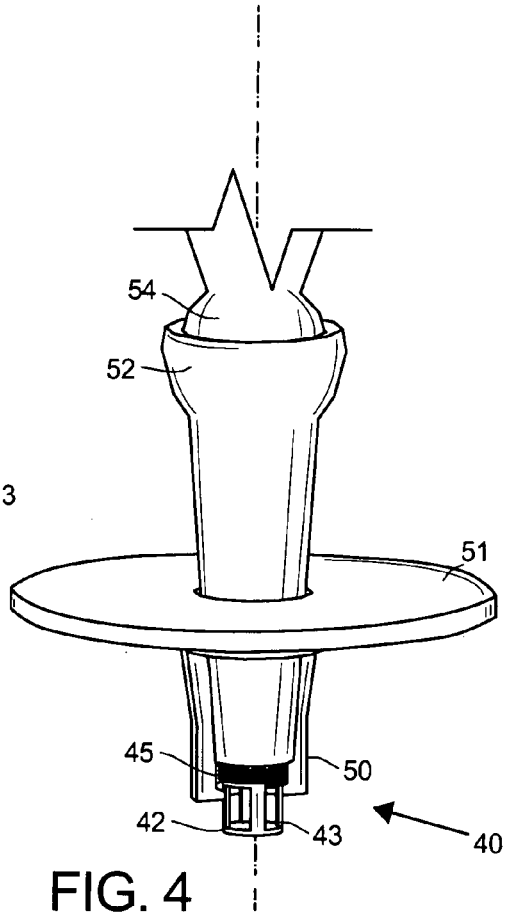
FIG. 4 is a diagrammatic perspective views of the funnel of the multipurpose funnel system of the present invention wherein the inside sleeve of the check valve is in the open position.

FIGS. 3 and 4 illustrated a check valve in an open and closed position. The elongated tip 50 of the funnel 13 includes a check valve 40 which controls the flow of liquid when opened and closed. The check valve 40 includes an inside sleeve 42 positionable within the elongated tip 50 and a spring 45. The spring 45 is coiled around the inside sleeve 42 between the inside sleeve 42 and the elongated tip 50. The inside sleeve 42 includes at least one opening 43 for allowing liquid to flow therethrough. The inside sleeve 42 extends outwardly and inwardly from the elongated tip 50, which opens and closes the opening 43 thereby controlling spillage.

The elongated tip 50 includes an exterior lip 51, having an outer edge 61 (shown in FIGS. 6 and 7), preferably made of rubber which extends outwardly therefrom. Alternatively, the exterior lip 51 is made out of plastic. The lip 51 rests against the container being filled, which in this preferred embodiment is an engine block. The lip 51 provides vertical stability preventing the funnel 13 from falling over. Additionally, the exterior lip 51 acts as a stop in conjunction with the check valve 40. When downward pressure is transferred from the downspout 13 to the elongated tip 50 and lip 51, the spring 45 coils and the inside sleeve 42 slides downwardly opening the check valve 40 to allow liquid to flow out the opening 43. When pressure is removed from the elongated tip 50, the spring 45 uncoils and the inside sleeve 42 slides upwardly closing off the flow of liquid and preventing spillage of said liquid.

Additionally, the downspout 14 above the ball and socket mechanism 70 may include a threading 71, as shown in FIG. 3. The threading 71 allows the downspout 14 to be unthreaded and removed and used alone without the bottle cartridge 12 attached thereto to fill the container with liquid.

In use filling the container with liquid, a user first places the inverted bottles 11 of liquid securely within the bottle cartridge 12 by accepting the interlocking tabs 30 of the bottle 11 within the corresponding notches 31 of the funnel 13. Next, the user secures the bottles 11 in position by closing the parallel rods 18 across the open top end 12A of the bottle cartridge 12 and locking said rods 18 in position. The flow of liquid is increased by gravity as spikes of the rods puncture the bottom ends of the bottles allowing air to flow through the hollow spikes. The mechanic then inserts the elongated tip 50 into the container, even if the container is hard to reach because it is at an unusual angle, by allowing the tip 50 to freely rotate about the ball and socket mechanism 70. The system 10 is stabilized by allowing the lip 51 of the elongated tip 50 to rest against the container. Spillage is controlled by the check valve 40 by the inside sleeve 42 extending outwardly and inwardly from the elongated tip 50. Liquid is poured into the container by exposing the opening 43 by sliding the inside sleeve 42 downwardly by transferring pressure from the downspout 14 to the elongated tip 50 and lip 51 and allowing the spring 45 to coil. Closing off the flow of liquid by removing pressure from the elongated tip 50 causing the spring 43 to uncoil and the inside sleeve 42 to slide upwardly.

Additionally, the downspout 14 above the ball and socket mechanism 70 may include a threading 71, as shown in FIG. 3. The threading 71 allows the downspout 14 to be unthreaded and removed and used alone without the bottle cartridge 12 attached thereto. A bottle may be inverted and threaded into the threading 71 of the downspout 14 and similarly use to fill the container with liquid.

Figure 5:
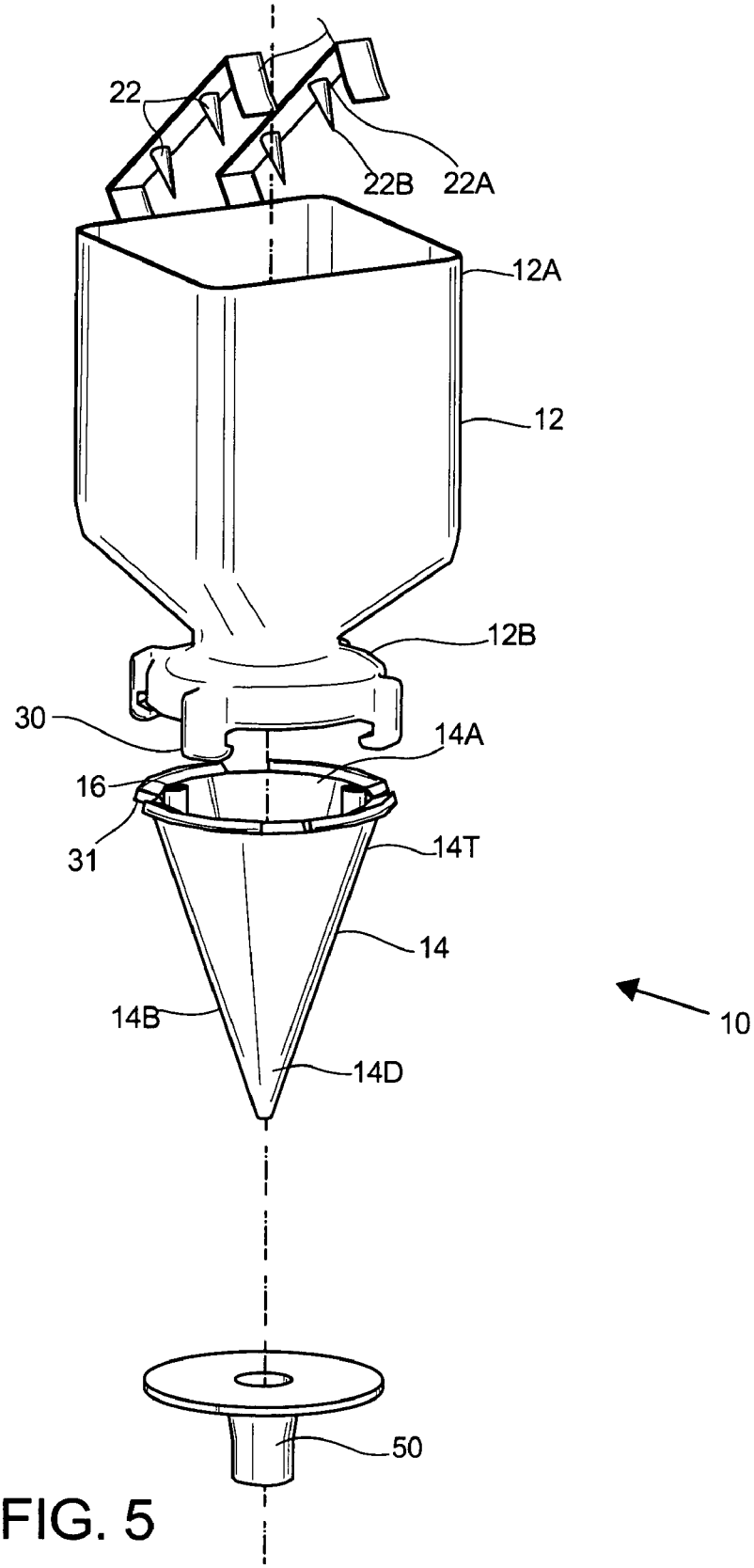
FIG. 5 is a diagrammatic perspective view of the multipurpose funnel system without the ball and socket mechanism.

FIG. 5 illustrates an alternate embodiment of the funnel system 10. In this embodiment, the funnel system 10 does not posses the ball and socket mechanism 70 which is comprised of the ball 54 and the socket 52. Rather, the downspout 14 feeds directly into the elongated tip 50 allowing liquid to freely flow from the bottle cartridge 12 through the elongated tip 50 into the container being filled.

There are four separate embodiments of the present invention wherein all illustrate unique ways for coupling the funnel system 10 to various systems, including, but not limited to small engines, outdoor power equipment, motorcycles, marine engines, farm equipment, automotive, diesel and aerial engines. Each of the embodiments may be used on the funnel system 10 containing the ball and socket mechanism 70, or the funnel system 10 without the ball and socket mechanism 70.

Figure 6:
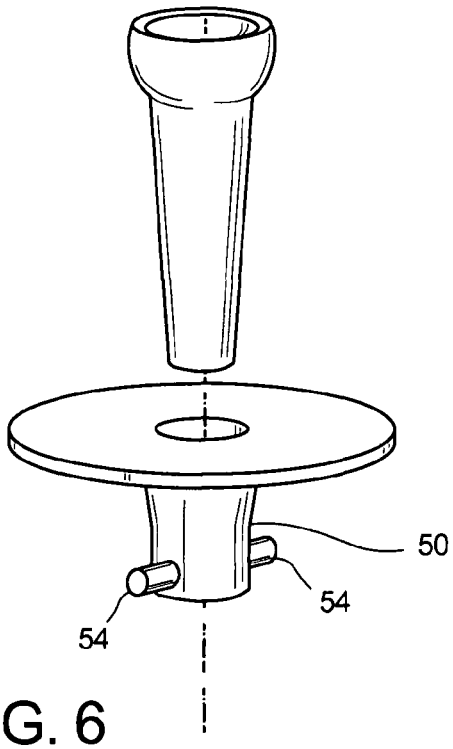
FIG. 6 is a diagrammatic perspective view of the funnel of the multipurpose funnel system of the present invention having an elongated tip which contains dual tabs extending outwardly therefrom.

FIG. 6 illustrates an alternate embodiment of the present invention, wherein the elongated tip 50 includes dual tabs 54 extending outwardly therefrom. The dual tabs 54 preferably couple with a valve cover for an oil fill cap having slotted internal grooves where the dual tabs 54 slide and lock into position, wherein the valve cover may contain an adapter. Alternatively, the dual tabs 54 are located on the exterior lip 51 of the elongated tip 50.

Figure 7:
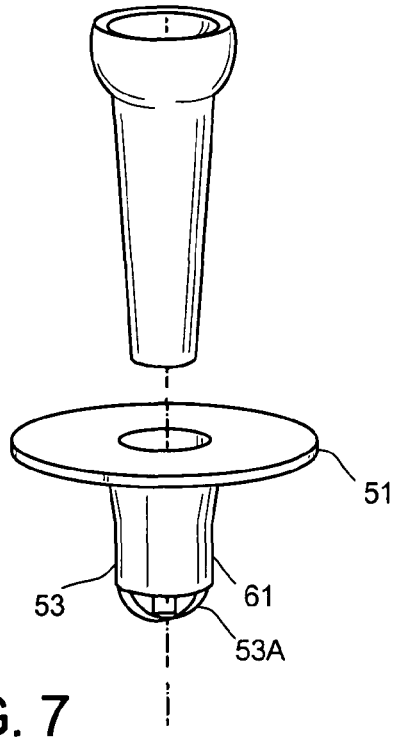
FIG. 7 is a diagrammatic perspective view of the elongated tip of the multipurpose funnel system of the present invention, having an exterior lip that contains an outer edge which extends outwardly and downwardly therefrom to define a rim, wherein the rim contains an interior side having threading.

FIG. 7 illustrates another alternate embodiment of the present invention, wherein the outer edge 61 of the exterior lip 51 extends outwardly and downwardly to define a rim 53. The rim 53 has an interior side 53A which includes threading for coupling the funnel 13, onto an oil fill neck.

Figure 8:
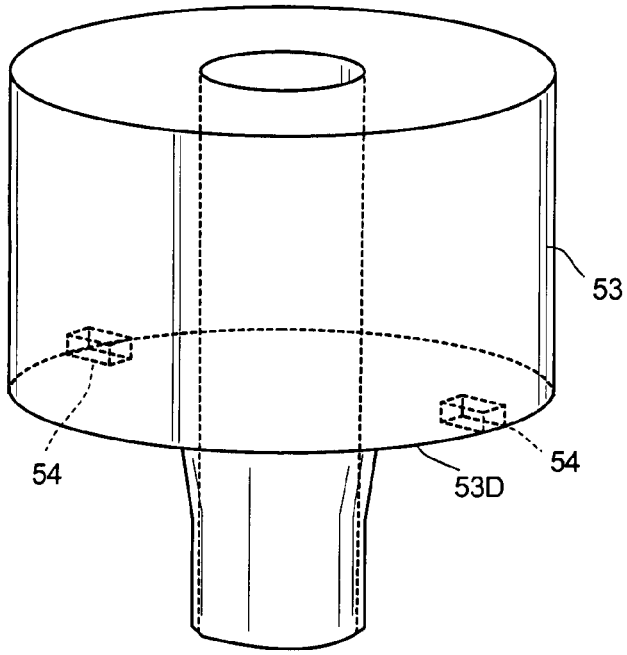
FIG. 8 is a diagrammatic perspective view of the funnel of the multipurpose funnel system of the present invention, wherein the rim of the funnel contains dual tabs.

FIG. 8 illustrates yet another alternate embodiment of the present invention, wherein the rim 53 includes a bottom side 53D, having dual tabs 54 extending outwardly therefrom. Here, the dual tabs 54 preferably couple with slotted grooves in the valve cover of an oil fill cap in an automotive engine having locking tabs where the dual tabs 54 slide and lock into position.

Figure 9:
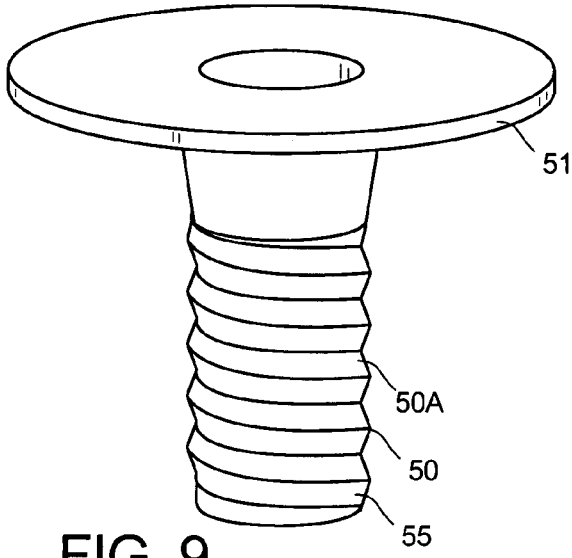
FIG. 9 is a diagrammatic perspective view of the funnel of the multipurpose funnel system of the present invention, wherein the elongated tip has an exterior side containing threading.

FIG. 9 illustrates an additional alternate embodiment of the present invention, wherein the elongated tip 50 has an exterior side 50A having threading 55. The threading 55 allows coupling of the elongated tip 50, preferably into an engine block. Preferably, the threading 55 on the exterior size 50A of the elongated tip 50 corresponds with threading on a factory dip stick or oil cap. Preferably, the threading 55 extends from the elongated tip 50 to the exterior lip 51, allowing the exterior lip 51 to provide stability.

FIG. 10A illustrates another alternate embodiment of the present invention to selectively regulate the flow of liquid through the funnel system 10. In this embodiment, the socket 52 contains an inner socket tip 52A having internal grooves 57 with three detent positions 57A, 57B and 57C. Each detent position 57 correlates to a different flow rate for a fluid poured through the funnel system 10. The first position 57A is fully closed and prohibits fluid from flowing through the elongated tip 50. The second position 57B is the one-half open position, allowing moderate fluid to flow through the elongated tip 50. The third position 57C is the fully open position, allowing fluid to freely flow through the elongated tip 50. The socket 52 also includes an outer socket tip 52B with a tab 59 that rides in the internal grooves 57.

FIG. 10B illustrates the socket 52 having the inner socket tip 52A with a half moon shape opening 63A and the outer socket tip 63B with a half moon shape opening 63B. When the funnel system is in the first position 57A, the two openings 63A and 63B are opposite of each other to prevent fluid from flowing through the elongated tip 50.

In use, the outer socket tip 52B will rotate from a position of zero degrees to a position of approximately 45 degrees moving the tab 59 from the closed position 57A in the internal grooves allowing downward pressure to be applied to the check valve 40 of the elongated tip 50 allowing fluid to flow. A user may adjust the flow of fluid through the funnel system 10 by rotating the tab 59 clockwise from the fully closed position 57A into the internal grooves 57, wherein downward pressure is applied to the check valve 40 allowing, the tab 59 to move upward and rotate into the half open position 57B. A user may then repeat the process above to move the tab to the fully open position 57C.

In conclusion, herein is presented an improved multipurpose funnel system. The invention is illustrated by example in the drawing figures, and throughout the written description. It should be understood that numerous variations are possible, while adhering to the inventive concept. Such variations are contemplated as being a part of the present invention.

What is claimed is:

1. A multipurpose funnel system, comprising:

an interchangeable funnel having a downspout, an elongated tip and a ball and socket mechanism, the downspout having an inside surface, an exterior wall, a top and bottom end, a threading, and a plurality of integrated venting tubes spaced evenly around the inside surface of the downspout, the top end having a plurality of notches, the elongated tip having dual tabs extending outwardly therefrom, the elongated tip having a socket, the bottom end of the downspout having a ball, wherein the ball of the downspout is accepted by the socket of the elongated tip to form the ball and socket mechanism, the elongated tip includes a check valve having an inside sleeve and a spring, the spring is coiled around the inside sleeve between the inside sleeve and the elongated tip and includes at least one opening, the inside sleeve extends outwardly and inwardly from the elongated tip, which opens and closes the opening, the elongated tip having an exterior lip extending outwardly therefrom;

an interchangeable bottle cartridge removeably coupled to the funnel and having a bottom end and an open top end having opposing sides, the bottom end having a plurality of interlocking tabs corresponding to the notches of the funnel for accepting the interlocking tabs of the bottle cartridge therein; and a pair of parallel rods hingedly connected along one side of the bottle cartridge and closing across the open top end before locking at the opposing side, having at least one hollow cone shaped spikes extending outwardly therefrom and each spike having a top end and pointed tip.

2. The multipurpose funnel system of claim 1, wherein the elongated tip includes an exterior lip having an outer edge extending outwardly and downwardly to define a rim, the rim having an interior side which includes threading.

3. The multipurpose funnel system of claim 2, wherein the rim includes a bottom side, having dual tabs extending outwardly therefrom.

4. The multipurpose funnel system of claim 1, wherein the elongated tip has an exterior side that includes threading.

5. The multipurpose funnel system of claim 4, further comprising an inner socket tip having internal grooves with three detent positions, including a first, second and third position, each detent position corresponding to a different flow rate and a half moon shape opening; and an outer socket tip with a tab that rides in the internal grooves and a half moon shape opening covering.

6. A multipurpose funnel system, comprising:

a funnel having a downspout, an elongated tip, the downspout having an inside surface, an exterior wall, a top and bottom end, the elongated tip includes a check valve having an inside sleeve and a spring, the spring is coiled around the inside sleeve between the inside sleeve and the elongated tip and includes at least one opening, the inside sleeve extends outwardly and inwardly from the elongated tip, which opens and closes the opening, the elongated tip having an exterior lip extending outwardly therefrom;

a bottle cartridge removeably coupled to the funnel and having a bottom end and an open top end having opposing sides; and a pair of parallel rods hingedly connected along one side of the bottle cartridge and closing across the open top end before locking at the opposing side, having at least one hollow cone shaped spikes extending outwardly therefrom.

7. The multipurpose funnel system of claim 6, wherein the funnel and bottle cartridge are interchangeable.

8. The multipurpose funnel system of claim 7, wherein the top end of the funnel has a plurality of notches and the bottom end of the bottle cartridge has a plurality of interlocking tabs corresponding to the notches of the funnel for accepting the interlocking tabs of the bottle cartridge therein.

9. The multipurpose funnel system of claim 8, wherein a plurality of integrated venting tubes are spaced evenly around the inside surface of the downspout.

10. The multipurpose funnel system of claim 9, wherein each spike has a top end and pointed tip.

11. The multipurpose funnel system of claim 10, wherein the elongated tip includes dual tabs extending outwardly therefrom.

12. The multipurpose funnel system of claim 10, wherein the elongated tip includes an exterior lip having an outer edge extending outwardly and downwardly to define a rim, the rim having an interior side which includes threading.

13. The multipurpose funnel system of claim 10, wherein the rim includes a bottom side, having dual tabs extending outwardly therefrom.

14. The multipurpose funnel system of claim 10, wherein the elongated tip has an exterior side that includes threading.

15. A method for adjusting the flow rate of a fluid comprising a multipurpose funnel system having a ball and socket mechanism, wherein the socket includes an inner socket tip having internal grooves having three detent positions, including a first, second and third position, each position corresponding to a different flow rate, a half moon cover opening on the inner socket tip, an outer socket tip having a tab that rides in the internal grooves and a half moon cover opening, the steps comprising:

rotating the tab clockwise from the first detent position into the internal grooves;

applying downward pressure allowing the tab to move upward and rotate into the second detent position;

rotating the tab clockwise from the second detent position into the internal grooves; and applying downward pressure to allow the tab to move upward and rotate into the third detent position.

* * * * *